United States Patent [19]

Fujii et al.

[11] Patent Number: 4,640,729

[45] Date of Patent: Feb. 3, 1987

[54] METHOD OF PRODUCING IONIZATION CHAMBER DETECTOR

[75] Inventors: Hideji Fujii, Nishitama; Takayuki Hayakawa, Hachioji; Shigeru Sato, Kitasoma; Eiichi Yanagihara, Yokohama, all of Japan

[73] Assignees: Hitachi, Ltd.; Hitachi Medical Corporation, both of Tokyo, Japan

[21] Appl. No.: 741,108

[22] Filed: Jun. 4, 1985

[30] Foreign Application Priority Data

Jun. 4, 1984 [JP] Japan ..... 59-114029

[51] Int. Cl.[4] ..... H01J 1/88; H01J 47/02

[52] U.S. Cl. ..... 156/257; 156/275.5; 156/293; 156/307.5; 156/307.7; 156/330; 250/367; 250/385

[58] Field of Search ..... 250/336.1, 363.2, 363.4, 250/363.8, 367, 385; 156/275.5, 293, 257, 307.5, 307.7, 330; 313/326

[56] References Cited

U.S. PATENT DOCUMENTS

| | | | |
|---|---|---|---|
| 3,056,187 | 10/1962 | Ryan | 156/293 |
| 3,284,258 | 11/1966 | Patti et al. | 156/293 |
| 3,655,854 | 4/1972 | Deinsenroth | 156/293 |
| 3,872,198 | 3/1975 | Britton | 156/293 |
| 4,075,527 | 2/1978 | Cummings | 156/330 |
| 4,119,853 | 10/1978 | Shelley et al. | 250/385 |
| 4,222,635 | 9/1980 | Julke | 156/275.5 |
| 4,272,680 | 6/1981 | Cotic | 250/385 |
| 4,283,817 | 8/1981 | Cotic | 156/293 |
| 4,297,401 | 10/1981 | Chern et al. | 156/275.5 |
| 4,345,156 | 8/1982 | Ishikawa et al. | 250/385 |
| 4,491,734 | 1/1985 | Yamaguchi et al. | 250/385 |
| 4,521,689 | 6/1985 | Pritzkow | 250/367 |

FOREIGN PATENT DOCUMENTS

| | | | |
|---|---|---|---|
| 153687 | 4/1979 | Japan | 250/385 |
| 153686 | 4/1979 | Japan | 250/385 |
| 103378 | 8/1981 | Japan | 250/385 |
| 196475 | 11/1983 | Japan | 250/385 |
| 60272 | 4/1984 | Japan | 250/336.1 |

*Primary Examiner*—Jerome Massie

*Attorney, Agent, or Firm*—Antonelli, Terry & Wands

[57] ABSTRACT

In an ionization chamber detector of the type in which a plurality of flat anode and cathode electrodes are alternately arranged in a predetermined gaseous medium, this invention provides a method of producing an ionization chamber detector which is characterized in that a plurality of ditches having a width a little bit greater than the thickness of the electrodes are formed on the inner surfaces of a pair of insulators disposed in the spaced-apart relation for supporting and fixing the anode and cathode electrodes, an adhesive is applied in advance temporarily in a rectangular form to both or one surface of each electrode at those positions which are set back by a distance corresponding to the thickness of the electrodes from both edge portions, another adhesive having a low viscosity is charged from the end portions of the ditches into the gaps between the electrodes and the ditch walls after the electrodes are inserted into the ditches, and the tentative adhesive and the adhesive having a low viscosity are then cured integrally in order to firmly bond and fix the electrodes into the ditches. This method can keep the distance between the electrodes highly accurate and can bond and fix reliably and stably the electrodes into the ditches.

14 Claims, 11 Drawing Figures

METHOD OF PRODUCING IONIZATION CHAMBER DETECTOR

BACKGROUND OF THE INVENTION

This invention relates generally to a method of producing an ionization chamber detector, and more particularly to a method of fixing electrodes of an ionization chamber detector for use in computed tomograph.

A whole body CT (compound tomograph) has a construction such as shown in FIGS. 1(*a*) and 1(*b*). A hole 21 is bored at the center of a disc 20 for the insertion of the head or abdominal region of a man, an X-ray tube 22 is mounted onto the disc 20 and an X-ray detector 23 is disposed on the disc 20 in such a manner as to oppose the X-ray tube 22. A subject is interposed between the X-ray tube 22 and the detector 23, and an X-ray beam is rotated and radiated on a predetermined plane while the disc 20 is being rotated. The detector 23 receives the beam and an image is re-constructed by a computer from the output data of the detector 23.

An ionization chamber detector for measuring the spatial distribution of X-rays has been used as the detector 23 described above.

The ionization chamber detector 23 has a construction such as shown in FIG. 2. A plurality of flat anodes 2 and a plurality of flat cathodes 3 are arranged in such a manner as to keep substantially parallel gaps between them, and a gas such as Xe gas of from about 10 to about 50 atms is then sealed.

When the X-rays are incident to the ionization chamber detector described above, they are dissociated to the xenon ion $Xe^+$ and the electron $e^-$, and a dissociation current is collected by applying a high voltage across both electrodes 2 and 3.

As schematically illustrated in FIG. 3, a plurality each of anodes and cathodes are alternately arranged with substantially parallel gaps between them and are bonded and fixed to upper and lower insulators 1. In other words, ditches for supporting and fixing the flat electrodes 2, 3 are formed equidistantly on the insulators 1, and the electrodes 2, 3 are inserted into, and fixed to, these ditches. The X-rays are incident as a fan beam that expands in a substantially flat arcuate shape, for example, from the direction represented by an arrow in FIG. 3. Therefore, the dissociation current generated in the space existing between the anodes 2 and the cathodes 3 is measured as described above. The spatial resolution of the detector 23 of this kind is significantly affected by the number of detection cells consisting of the anodes 2 and the cathodes 3 per unit length in the direction of the fan-shaped arrangement and by the mechanical accuracy (the flatness of the electrodes, the accuracy of locating the ditches for supporting and fixing the electrodes, and the like). Therefore, the detector 23 generally consists of more than 1,000 pairs of detection cells to improve the spatial resolution. (Refer, for example, to Japanese Patent Laid-Open No. 69491/1979.)

However, the distance between each anode and cathode 2, 3 constituting the detection cell may be less than several hundred microns. Therefore, an extremely high level of skill is necessary in order to accurately form the ditches for inserting, supporting and fixing the electrodes while keeping an accurate distance between the electrodes 2, 3, and to bond and fix them into the ditches. If the electrodes are bonded and fixed insufficiently in the ditches, a microphonic noise develops due to the vibration of the electrodes. If a difference of more than about 10 microns exists between the electrodes 2 and 3 of adjacent detection cells, a ring-like artifact will appear in the reconstructed image. Therefore, such a detector cannot be used as a detector for a CT.

SUMMARY OF THE INVENTION

The Applicant of this invention proposed previously a production method such as shown in FIG. 4 (Japanese Patent Application No. 97789/1983) in order to bond and fix electrodes in ditches formed accurately on insulators without generating microphonic noise but while keeping accurate distances between the electrodes.

In FIG. 4, an adhesive 4 is temporarily applied in advance in a rectangular form to electrodes 2, 3, and a plurality of ditches having such a width as to accept the electrodes 2, 3 and the thickness of the adhesives are accurately formed on a pair of insulators that are spaced apart from each other. After the electrodes 2, 3 are inserted and supported into the ditches together with the adhesive 4, the adhesive 4 is cured under a predetermined condition so that the electrodes 2, 3 are bonded and fixed to the ditch walls. In this case, epoxy resins having a B stage or various thermoplastic resin films are used as the adhesive 4.

In accordance with the method of bonding and fixing the electrodes 2, 3 shown in FIG. 4, however, shrinkage of the adhesive 4 during curing exerts adverse influences and variance exists in the flatness of the electrodes 2 and 3. In addition, still another problem lies in a jig for arranging the pair of upper and lower insulators 1, on which the ditches are formed accurately, in the spaced-apart relation with a high level of accuracy. For these reasons, the electrodes 2 and 3 cannot always be satisfactorily bonded and fixed in the ditches. In other words, inspection of the bond-fixing portions, re-bonding of defective portions, and other additional production processes become necessary.

The width of each ditch to be formed on the insulator 1 must be greater than the sum of the thickness of the electrodes 2, 3 and the thickness of the adhesive 4. If the electrodes 2, 3 are 0.15 mm thick and the tentative adhesive 4 is about 0.05 mm thick, the total thickness is about 0.2 mm. In order to insert electrodes having such a total thickness into the ditch, the width of each ditch must be from about 0.22 to about 0.24 mm in consideration of the thickness of the electrodes 2, 3, the variations in their flatness and the variations of thickness of the tentative adhesive 4. When such a ditch is formed on the insulator 1 by use of a cutting tool, the width of the ditch is so great in this example that the ditch forming speed is too low, and since the insulator 1 is extremely hard, damage to the cutting edge is considerable and the accuracy of forming the ditch will fall off.

The present invention contemplates to produce a method of producing an ionization chamber detector which has high performance but is economical, by minimizing the width of ditches to be formed on insulators, keeping the distance between electrodes extremely accurate and bonding and fixing the electrodes into the ditches in such a manner as to prevent the occurrence of microphonic noise.

In an ionization chamber detector consisting of a plurality of flat anodes and cathodes that are alternately arranged in a predetermined gaseous medium, the object of the invention described above can be accomplished by an ionization chamber detector which is characterized in that a plurality of ditches, each having a width a little greater than the thickness of each electrode, are formed on the inner surfaces a pair of insulators that are spaced apart from each other in order to support and fix the anodes and cathodes; an adhesive is applied in advance temporarily in a rectangular form to either both surfaces or one surface of each electrode at positions that are set back inward from the edges by a distance corresponding to the depth of the ditch; after the electrodes having such a tentative adhesive applied thereto are inserted into the ditches, an adhesive having a low viscosity is charged between the electrodes and the groove walls from the edge portions of the grooves; and the tentative adhesive and the low viscosity adhesives are thereafter cured integrally in order to firmly bond and fix the electrodes into the ditches.

BRIEF DESCRIPTION OF THE DRAWINGS

FIG. 1(*b*) is a schematic side view showing the principle of a CT.

DESCRIPTION OF THE PREFERRED EMBODIMENTS

Hereinafter, some preferred embodiments of the present invention will be described with reference to the accompanying drawings.

Figure 1A:
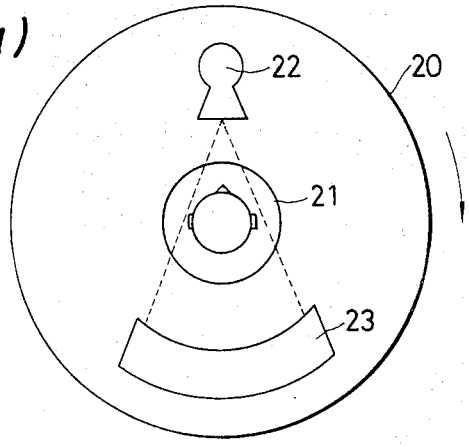
FIG. 1(*a*) is a schematic plane view showing the principle of a CT.
Figure 1B:
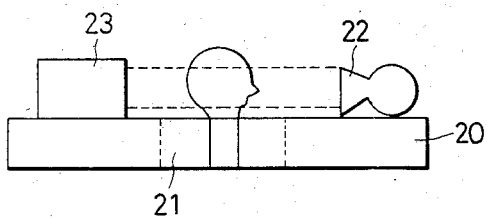
Figure 2:
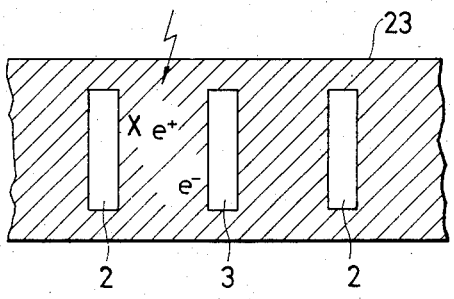
FIG. 2 is an explanatory view showing the operation principle of an ionization chamber detector.
Figure 3:
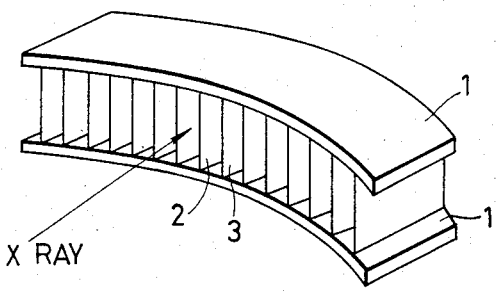
FIG. 3 is a perspective view of an X-ray detector.
Figure 4:
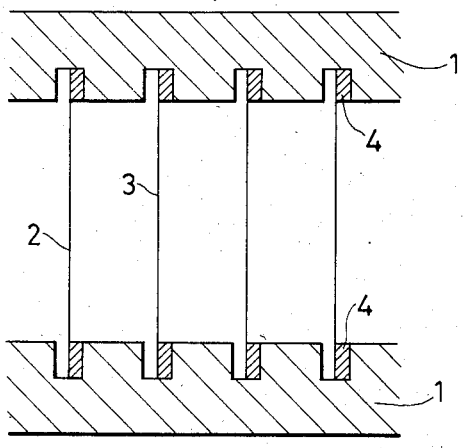
FIG. 4 is an explanatory view showing a conventional method of holding electrodes of an X-ray detector.
Figure 5A:
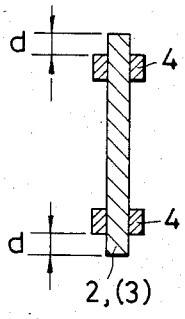
FIG. 5(*a*) and 5(*b*) are side and front views respectively showing electrodes before they are fitted, in accordance with one embodiment of the present invention.
Figure 5B:
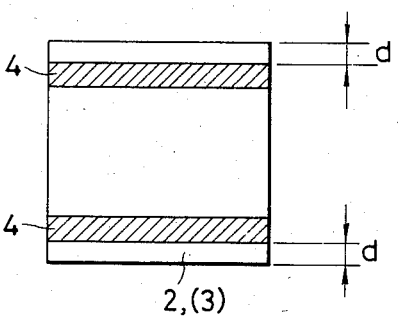

FIG. 5(*a*) and 5(*b*) are side and front views of electrodes in accordance with one embodiment of the present invention.

In this embodiment, the applying positions of an adhesive 4 to the electrodes 2, 3 are set back from both edges towards the center in a distance corresponding to the depth of the ditches. In other words, the adhesive 4 is applied temporarily in a rectangular form to those portions on both surfaces of the electrodes 2, 3 which are not inserted into the ditches. Therefore, the dimension d in FIGS. 5(*a*) and 5(*b*) may be either equal to the depth of the ditches formed on the insulator 1 or be greater by about 0.1 mm than the ditch depth. An epoxy resin having a B stage may be used as the tentative adhesive 4.

Figure 6:
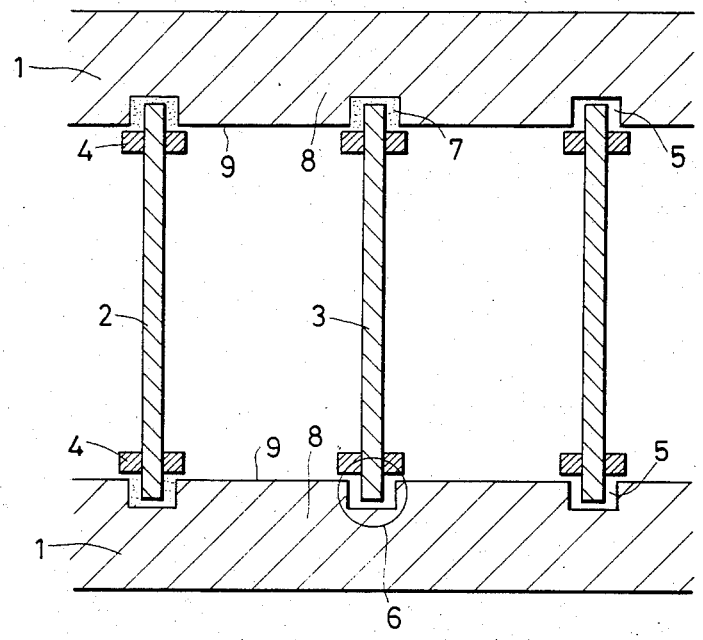
FIG. 6 is an explanatory view showing a method of bonding and fixing the electrodes shown in FIG. 5.

FIG. 6 shows the state in which the electrodes shown in FIG. 5 are inserted into the ditches.

The ditches are formed on a pair of opposed insulators 1 in order to insert and support the electrodes 2 and 3. The width of each ditch may be a minimum value into which the electrode 2, 3 can be inserted. If the electrodes 2, 3 are from 0.1 mm thick and 0.15 mm thick, for example, the ditch width for them may be sufficiently from 0.11 to 0.12 mm and from 0.16 to 0.17 mm, respectively.

The adhesive 4 is applied temporarily in a rectangular form by screen printing or other means to the positions set back by the distance d shown in FIG. 5. The thickness of the adhesive 4 is sufficiently from 0.05 to 0.1 mm, and accuracy of this thickness is not necessary.

The electrodes 2 and 3 having the temporarily adhesive 4 on both of their surfaces are then arranged to accurately face a large number of ditches having a minimum possible width into which the electrodes can be inserted, and then the electrodes 2, 3 are inserted into the corresponding ditches. After the electrodes 2 and 3 are inserted into all the ditches, a liquid adhesive having a low viscosity (such as an epoxy resin that can be diluted by a solvent) is charged into gaps 5 between the electrodes 2, 3 and the walls of the ditches as shown in FIG. 6. The volume of each gap 5 is extremely small. It is only $7\times10^{-4}$ cm$^3$ when the electrodes 2, 3 are 0.15 mm thick and are 35 mm long in the incident direction of X-rays, and the ditches are 0.17 mm wide and 1 mm deep, for example. The charging of the liquid adhesive in such a small volume can be realized easily by use of a precision liquid quantitization supplier which can control a charging quantity and is available commercially on the market.

The liquid adhesive is charged by positioning the liquid discharge tip of the precision liquid quantitization supplier to a portion 6 and then bringing the liquid adhesive into contact with the electrodes 2, 3 and with the tentative adhesive 4 at the edge portion 8 of each ditch so that the liquid adhesive 7 flows into the narrow gap 5 between the ditch wall and the electrodes 2, 3. Since the liquid adhesive 7 is charged from the edge portions 8 of the ditch at the upper and lower two positions, the ditch wall, the electrodes 2, 3 and the tentative adhesive 4 in each ditch interpose the adhesive 7 thus charged.

After the liquid adhesive 7 is charged into all the ditches, the adhesive 7 at all the positions is altogether cured under a predetermined temperature condition for a predetermined period of time while the electrodes 2 and 3 are kept substantially horizontal, whereby the electrodes 2 and 3 are completely bonded and fixed inside the ditches. Incidentally, when the liquid adhesive 7 is charged, it sometimes expands from the ditch edge portions 8 or on the ditch surface 9, but the performance of the X-ray detector can be maintained unaltered if a suitable liquid adhesive 7 is selected so that its electric characteristics after curing become appropriate.

Figure 7:
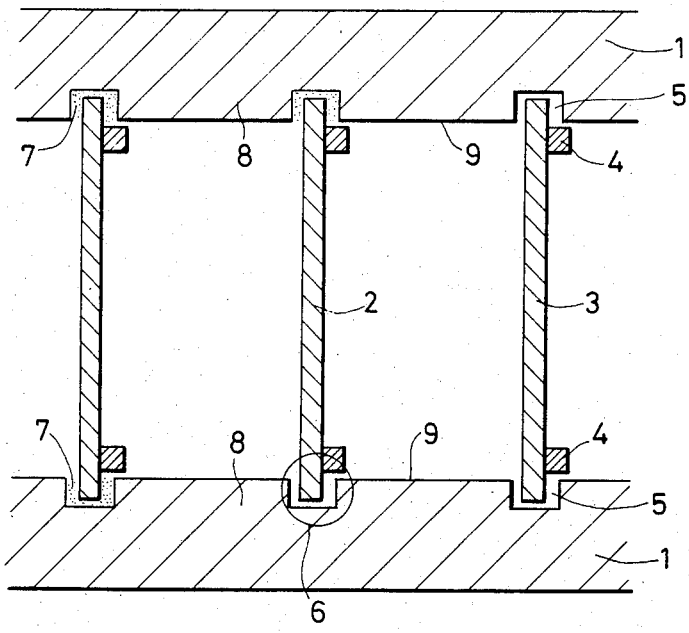
FIG. 7 is an explanatory view showing a method of bonding and fixing the electrodes as a modified embodiment of FIG. 6.

FIG. 7 is an explanatory view of a bonding and fixing method of the electrodes into the ditches as a modified example of the method shown in FIG. 6.

FIG. 7 shows the bonding and fixing method of the electrodes 2 and 3 into the ditches when the adhesive 4 is applied tentatively only to one surface of each electrode. In other words, the adhesive 4 is tentatively applied to only one surface of each electrode at positions which are set back by the dimension d equal to the ditch depth. After the electrodes 2 and 3 having this tentative adhesive 4 are then positioned accurately so as to face a large number of ditches of the insulators 1, they are inserted into the corresponding ditches. Thereafter, the liquid adhesive 7 having a low viscosity is charged into the gaps 5 between the electrodes 2, 3 and the ditch walls. The other bonding and fixing methods are exactly the same as those shown in FIG. 6.

In accordance with the electrode fixing methods shown in FIGS. 6 and 7, the adhesive 4 is temporarily applied at those portions of the electrodes which are not inserted into the ditches, and when melted, the temporary adhesive 4 flows into the ditches, and bonds and fixes the electrodes 2 and 3 to the ditch walls in cooperation with the liquid adhesive 7 that is then charged. Therefore, the ditch width can be set substantially equal to the width of each electrode 2, 3. Even if a difference exists in the melt quantities, or even if a difference exists in the thickness of the tentative adhesive 4, it is not necessary to raise the fitting accuracy. Therefore, the electrodes 2 and 3 can be arranged and firmly fixed with a high level of accuracy by a simple fitting method, thereby eliminating the vibration of the electrodes 2 and 3. Consequently, microphonic noise can be reduced and a ring-like artifact does not appear in the reconstructed image.

Figure 8:
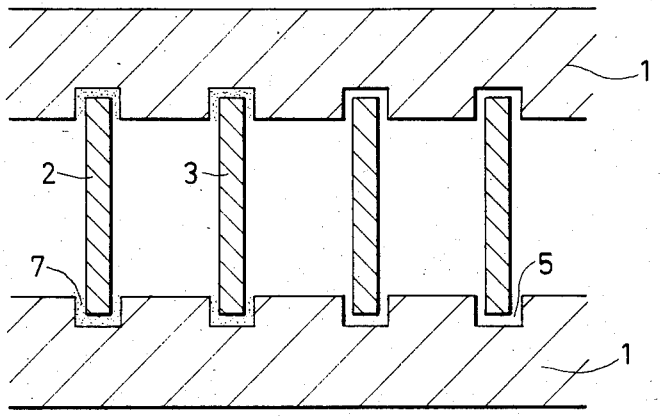
FIG. 8 is an explanatory view showing a method of bonding and fixing the electrodes in accordance with another embodiment of the present invention.
Figure 9:
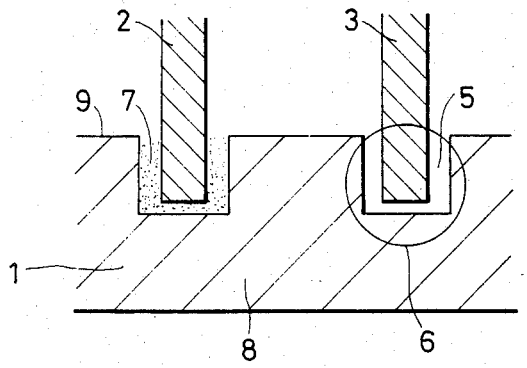
FIG. 9 is an enlarged view of the principal portions of FIG. 8.

FIG. 8 is an explanatory view showing the method of bonding and fixing the electrodes in accordance with another embodiment of the present invention. FIG. 9 is an enlarged view of FIG. 8.

In the embodiment shown in FIG. 8, the liquid adhesive 7 is charged into the gaps 5 between the ditches and the electrodes 2 and 3 without applying in advance the tentative adhesive 4, in order to bond and fix the electrodes 2 and 3.

In FIG. 8, a plurality of ditches into which a plurality of electrodes 2 and 3 are inserted are formed accurately on a pair of insulators 1 that are spaced apart from each other. The width of each ditch may be a minimum possible value so long as each electrode can be inserted into it. When the electrodes 2, 3 are 0.1 mm thick and 0.15 mm thick, for example, the ditches may sufficiently be 0.12 mm wide and 0.17 mm wide, respectively. After the insulator pair having a large number of ditches with a minimum possible width into which the electrodes 2 and 3 can be inserted are spaced apart accurately, all the electrodes 2 and 3 are inserted into the ditches. In this case, any treatment for bonding and fixing need not be made for the electrodes 2 and 3. In other words, it is not necessary to tentatively apply the adhesive 4 shown in FIGS. 6 and 7. After the electrodes 2 and 3 are inserted into all the ditches, a liquid adhesive 7 having a low viscosity (such as an epoxy resin that can be diluted by a solvent, for example) is charged into the narrow gaps 5 between the electrodes 2 and 3 and the ditch spaces. As explained already with reference to FIG. 6, the volume of this gap 5 may be as small as $7\times10^{-4}$ cm$^3$. The liquid adhesive can be charged easily into the gaps 5 by use of a precision liquid quantitization supplier which can control a charging quantity and which is available commercially. The liquid adhesive 7 is charged by arranging the liquid discharge tip of the precision liquid quantitization supplier to the portion 6, and then bringing it into contact with the electrode 2 or 3 at the end portion 8 of the insulator 1, thereby causing the liquid adhesive 7 to flow into the gaps 5. Since the liquid adhesive 7 is charged from both end portions 8 of the ditches, the ditch walls and the electrodes 2, 3 interpose the adhesive 7 inside the ditches. After the liquid adhesive 7 is charged into all the ditches, it is cured under predetermined conditions while the electrodes 2 and 3 are kept substantially horizontal, thereby bonding and fixing the electrodes 2 and 3 in the ditches.

An organic adhesive may be used as the liquid adhesive 7 depending upon the material of the insulator 1, but in order to charge the adhesive 7, the particle diameter of the adhesive 7 must be below 2 to 3 μm. A resin that can be cured both by ultraviolet rays and by heat can also be used, but the insulators 1 need not always be transparent. When the resin described above is used, the ultraviolet rays are radiated from the direction of both end portions 8 of the ditches shown in FIG. 9 to cure the portions which are transparent to the ultraviolet rays, and thereafter all the adhesive is cured by heat curing.

In the embodiment shown in FIGS. 8 and 9, too, the adhesive 7 sometimes expands from the edge portions 8 of the ditches or on the ditch surfaces 9 shown in FIG. 9. However, any adverse influences upon the performance of the X-ray detector can be prevented by selecting an adhesive 7 so that its electric characteristics after curing become appropriate, and by selecting a suitable curing condition.

In the embodiment described above and shown in FIG. 8, the width of the ditch may be a little greater than the thickness of each electrode 2, 3 when forming the ditch for forming the electrodes 2, 3 on the insulator 1. Therefore, the efficiency of the ditch formation can be improved. When the electrodes 2 and 3 are bonded and fixed in the ditches, it is necessary to insert only the electrodes 2 and 3 into the corresponding ditches, and the other necessary production steps are two steps of charging the liquid adhesive 7 and curing it. Therefore, the production steps can be remarkably reduced. Since the electrodes 2 and 3 can be arranged and firmly fixed with a high level of accuracy, the vibration of these electrodes 2 and 3 does not occur, so that the microphonic noise can be reduced and the ring-like artifact does not appear in the reconstructed image. Thus, a method of producing a high performance and economical X-ray detector can be accomplished.

In the embodiment shown in FIGS. 6 and 7, the adhesive 4 is tentatively applied to both or one surface of each electrode at the positions which are not inserted into the ditch, only the electrodes 2, 3 is inserted into the ditch, and thereafter the liquid adhesive 7 is charged into the gap inside the ditch in order to integrally cure the adhesives 4 and 7. Therefore, the width of the ditch of the insulator 1 may be only a little bit greater than the thickness of the electrodes 2, 3, that is, may be a minimum necessary width, thereby making it possible to improve the ditch formation efficiency. Moreover, the electrodes 2, 3 can be bonded and fixed to the ditch with a high level of accuracy and reliability. When the X-ray detector is produced in accordance with this method, the microphonic noise can be reduced and the ring-like artifact does not appear in the reconstructed image. Incidentally, the present invention can be applied to all those apparatuses which measure the X-ray intensity besides the CT.

As described above, the present invention makes it possible to minimize the width of the ditch to be formed on the insulator, to keep the distance between the electrodes highly accurate, and to bond and fix the electrodes in the ditches of the insulators. Therefore, the present invention can realize a high performance and economical ionization chamber detector, and can substantially eliminate microphonic noise and the ring-like artifact in the reconstructed image.

What is claimed is:

1. A method of manufacturing an ionization chamber detector of the type in which a plurality of flat anode and cathode electrodes are alternately arranged in a predetermined gaseous medium, comprising the steps of:

forming a plurality of ditches of predetermined depth on respective surfaces of a pair of insulators;

disposing said insulators in spaced-apart relation, whereby opposing edges of said anode and cathode electrodes can be supported and fixed in said ditches;

applying a first adhesive having a B stage to portions of at least one surface of said anode and cathode electrodes, said portions being spaced a predetermined distance from the opposing edges of said anode and cathode electrodes which are to be supported and fixed in said ditches;

inserting the opposing edges of said anode and cathode electrodes, having said B stage adhesive thereon, respectively into said ditches on said respective surfaces of said pair of insulators such that there is a gap between said anode and cathode electrodes and the walls of said ditches;

charging a second curable adhesive having a low viscosity into the gaps between said anode and cathode electrodes and walls of said ditches; and curing integrally said first adhesive having a B stage and said second adhesive in order to bond and fix said anode and cathode electrodes in said ditches.

2. A method of producing an ionization chamber detector as defined in claim 1, wherein said first adhesive having a B stage is applied to portions of at least one surface of said anode and cathode electrodes, said first adhesive being applied in a rectangular form.

3. The method of producing an ionization chamber detector as defined in claim 2, wherein said predetermined distance is equal to said predetermined depth of said ditches.

4. The method of producing an ionization chamber detector as defined in claim 2, wherein said predetermined distance is about 0.1 mm greater than the predetermined depth of said ditches.

5. A method of producing an ionization chamber detector as defined in claim 3, wherein said second adhesive is charged from end portions of said ditches into the gaps between said anode and cathode electrodes and said walls of said ditches.

6. The method of producing an ionization chamber detector as defined in claim 1, wherein said ditches have a width 0.01 to 0.02 mm wider than a thickness of a respective one of said anode and cathode electrodes.

7. The method of producing an ionization chamber detector as defined in claim 2, wherein said ditches have a width 0.01 to 0.02 mm wider than a thickness of a respective one of said anode and cathode electrodes.

8. The method of producing an ionization chamber detector as defined in claim 3, wherein said ditches have a width 0.01 to 0.02 mm wider than a thickness of a respective one of said anode and cathode electrodes.

9. The method of producing an ionization chamber detector as defined in claim 5, wherein said ditches have a width 0.01 to 0.02 mm wider than a thickness of a respective one of said anode and cathode electrodes.

10. The method of producing an ionization chamber detector as defined in claim 1, wherein said second adhesive is an epoxy resin diluted with solvent.

11. The method of producing an ionization chamber detector as defined in claim 1, wherein said insulators are made of a transparent material and said second adhesive is a resin, curable by UV, the liquid adhesive having a low viscosity.

12. The method of producing an ionization chamber detector as defined in claim 1, wherein the first adhesive is applied to both surfaces of the anode and cathode electrodes.

13. The method of producing an ionization chamber detector as defined in claim 1, wherein particulate matter of the second adhesive has a maximum particle size of 3 μm.

14. The method of producing an ionization chamber detector as defined in claim 1, wherein the first adhesive is applied to one surface of each of the anode and cathode electrodes.

* * * * *